US006000771A

United States Patent [19]

Wissinger et al.

[11] Patent Number: 6,000,771

[45] Date of Patent: Dec. 14, 1999

[54] RV REFRIGERATOR WITH SWINGING CLOSURE DOOR CAPABLE OF BEING OPENED FROM BOTH LEFT AND RIGHT SIDES

[75] Inventors: John W. Wissinger, Gregory; John R. Selina, Brighton, both of Mich.; James C. Butler; David W. Leistner, both of Sidney, Ohio; John M. Antos, Ann Arbor, Mich.

[73] Assignee: Thetford Corporation, Ann Arbor, Mich.

[21] Appl. No.: 09/153,510

[22] Filed: Sep. 15, 1998

Related U.S. Application Data

[60] Provisional application No. 60/060,087, Sep. 26, 1997.

[51] Int. Cl.[6] ..... A47B 96/04

[52] U.S. Cl. ..... 312/405; 49/193; 49/382; 312/401

[58] Field of Search ..... 312/405, 400, 312/401, 325, 326, 329; 16/230, 231, 232, 309; 49/192, 193, 382

[56] References Cited

U.S. PATENT DOCUMENTS

| | | | |
|---|---|---|---|
| 2,357,397 | 9/1944 | Fuller | 49/193 |
| 3,628,845 | 12/1971 | Grimm . | |
| 3,889,419 | 6/1975 | Maleck | 49/193 |
| 4,090,274 | 5/1978 | Bourgeois | 16/309 |
| 4,222,149 | 9/1980 | Holbeck | 49/193 X |
| 4,503,582 | 3/1985 | Gurubatham | 49/382 X |
| 4,609,234 | 9/1986 | Naniwa et al. | 312/296 |
| 5,500,984 | 3/1996 | Lee | 16/309 |
| 5,530,992 | 7/1996 | Baermann | 49/382 X |
| 5,675,934 | 10/1997 | Park | 49/193 |
| 5,829,197 | 11/1998 | Oh | 49/382 X |

*Primary Examiner*—Jose V. Chen
*Assistant Examiner*—Hanh V. Tran
*Attorney, Agent, or Firm*—Harness, Dickey & Pierce P.L.C.

[57] ABSTRACT

A refrigerator for RVs comprising an upright cabinet with an internal cold compartment and a door member mounted on the cabinet for closing said compartment, two pairs of upright hinge pins on the cabinet on opposite sides of the door enables the door to swing from both right and left sides of the cabinet. A single actuator is provided for putting the door from a left swing to a right swing and vice versa. In addition, the actuator can secure the door on the cabinet during RV travel. It can also enable easy removal of the door from the cabinet. Cams and cam followers are associated with the cabinet and the door to cause the door to be lifted when opened and lowered when closed to assure easy opening and closing of the door.

2 Claims, 4 Drawing Sheets

RV REFRIGERATOR WITH SWINGING CLOSURE DOOR CAPABLE OF BEING OPENED FROM BOTH LEFT AND RIGHT SIDES

This application claims the benefit of U.S. Provisional Application No. 60/060,087 filed Sep. 26, 1997.

BACKGROUND OF THE INVENTION

This invention relates generally to a refrigerator for a recreational vehicle (RV) where living space is limited and the flexibility of a refrigerator that can be opened and closed from different sides is desirable. More particularly, the refrigerator of this invention is provided with an actuator member in a prominent place on the refrigerator door. Use of the actuator member manifests a setting of "left", "right" or "locked" for the door. The RV refrigerator of this invention is also advantageously used because it has the ability to have its door readily removable from the refrigerator body whenever this is desired.

SUMMARY OF THE TNVENTION

The present invention provides a door for closing an opening in the cabinet of a refrigerator, which door can be selectively opened in either one of two directions. To accomplish this, the opening in the cabinet is provided with a first set of hinge pins along one side of the opening and a second set along the opposite side. The door is provided with means for selectively engaging either the first set or the second set of hinge pins to form the hinge mounting either on a first or second side of the door so that the door may be selectively opened in either of two different directions. The door is provided with a readily accessible actuator member for shifting the engagement means into engagement with either of the first or second sets of hinge pins. In the preferred embodiment, the engagement means comprises a pair of slide members mounted for sliding movement on a support member between a first position entrapping a hinge pin received in a recess on one side of the door to a second position entrapping the hinge pin received in a recess on the opposite side of the door.

In this invention, a refrigerator cabinet is provided with an access door which can readily be manipulated so that it can swing open from one or the other sides of the refrigerator cabinet. This enables maximum use of the limited space in the recreational vehicle in which the refrigerator is installed.

The refrigerator cabinet is provided with hinge pins at the corners of the cold compartment, the upper and lower pins on the left hand side of the compartment are aligned to provide a hinge axis and the hinge pins on the right hand side of the compartment are similarly positioned to provide a vertical pivot axis on the right hand side.

Actuating slides are provided at the top and bottom ends of he door for coaction with the hinge pins to mount the door so that it will pivot around the desired axis. The actuating slides are connected so that they move in unison and the user can quickly select opening of the door from either side or lock the door in a travel position.

The inside of the refrigerator door is commonly used for storing bottles, cans and other similar containers. The storage articles add to the weight of the door so that there is a tendency of the door to sag making it difficult to achieve an air-tight closure when the door is closed.

In the RV refrigerator of this invention, cam and cam follower assemblies are installed on the bottom side of the door and the lower hinge pins to insure quick lifting of the door when it is opened so that when it is subsequently swung toward its earlier closed position, it will automatically return to the closed position.

Further objects, features and advantages of this invention will become apparent from a consideration of the following description sand the appended claims when taken in connection with the accompanying drawing.

BRIFF DESCRTPTION OF THF DRAWTNGS

DESCRIPTION OF THE PREFERRED EMBODIMENT

Figure 1:
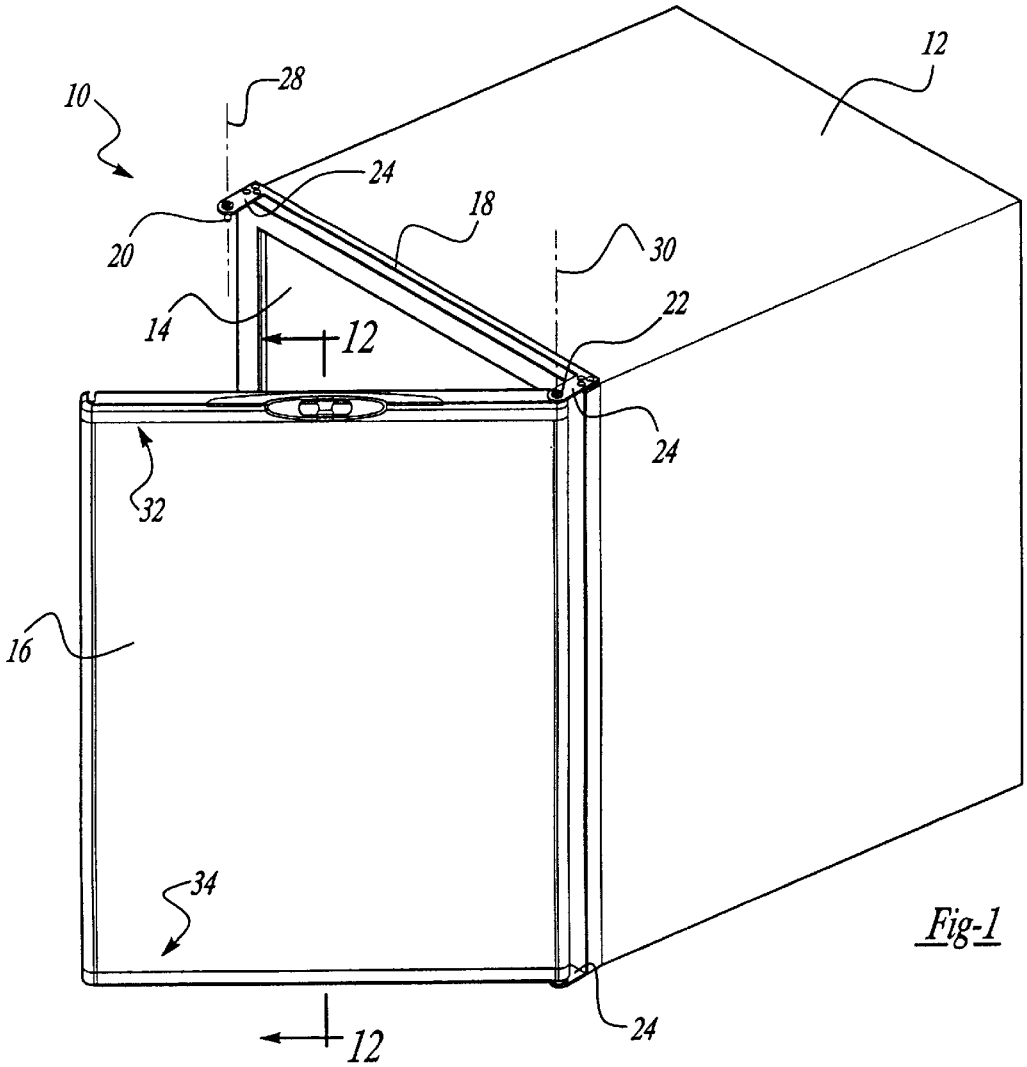
FIG. 1 is a perspective view of the RV refrigerator of this invention.

With reference to the drawing, the RV refrigerator of this invention, indicated generally at 10, is shown in FIG. 1 as including a cabinet 12 which encloses a cold compartment 14. Access to the cold compartment 14 is achieved by opening the door 16 which is mounted on the cabinet 12 for movement between open and closed positions. The door 16 is illustrated in FIG. 1 in which might be called a half-open condition.

A pair of door support brackets 18 are secured to the top and bottom sides of the cabinet 12, each bracket 18 terminating at its ends in forwardly extending legs 24. The legs 24 function to position a pair of left side hinge pins 20 and a pair of right side hinge pins 22 in positions spaced forwardly from the front wall 26 of the cabinet 12.

The hinge pins 20, only one of which appears in the drawing, are vertically aligned on the left hand side of the compartment 14 and the hinge pins 22 on the right hand side of the compartment 14 are similarly aligned. Thus, the hinge pins 20 and 22 define axes 28 and 30 of rotation for the door 16 which can be mounted so that it can swing outwardly away from the cabinet front wall 26 about either the left hand axis 28 or the right hand axis 30.

The door 16 is provided at its upper and lower ends with hinge control assemblies 32 and 34 (FIG. 1) which can be adjusted to provide for either left hand hinging of the door 16 on the hinge pins 20 or right hand hinging on the hinge pins 22, as shown in FIG. 1. Each of the hinge control assemblies 32 and 34 includes an actuating slide member 36 shown in FIGS. 2, 3 and 4.

Figure 2:
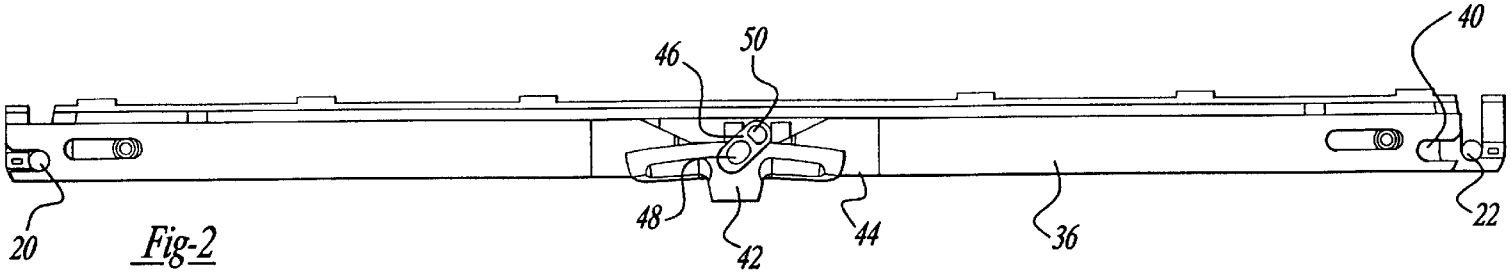
FIG. 2 is a plan view of the upper slide member in a position moved to the left to mount the door on the hinge pins on the left side of the refrigerator cabinet.

FIG. 2 illustrates the position of an actuating slide member 36 in which it has captured the hinge pins 20 so that the slide member 36 can rotate about the axis 28 of the hinge pins 20 but cannot be separated from its support on the hinge pins 20. Conversely, the hinge pins 22 are in a clearance relation with the slide member 36. This is due to the fact that the slot 38 at the end of the bar 36 adjacent the hinge pin 20 is in a coupled position with the hinge pin 20. Conversely, the slot 40 at the other end of the slide member 36 is in a clearance relation with the hinge pin 22.

Figure 4:
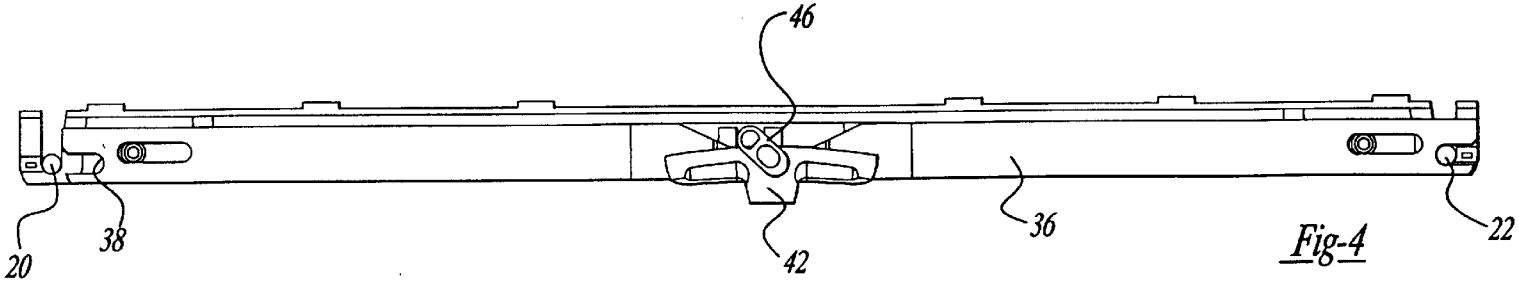
FIG. 4 is another plan view of the upper slide member, showing the slide member in its position moved to the right in which the cabinet door is mounted on the hinge pins on the right hand side of the cabinet thereby enabling opening of the refrigerator door in a clockwise direction about an axis extending vertically through the right hand hinge pins.
Figure 6:
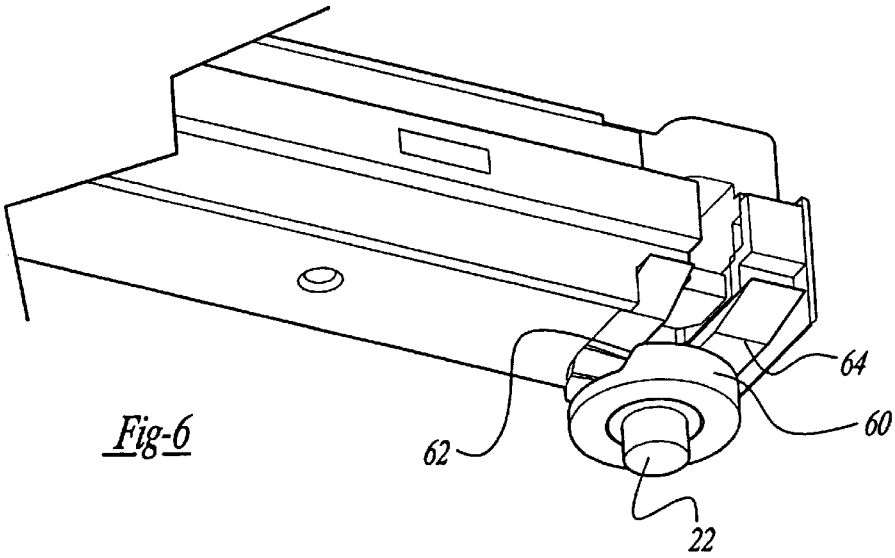
FIG. 6 is a fragmentary perspective view of the lower corner of the RV refrigerator door illustrating the location of the follower for the cam shown in FIG. 5 and illustrating the position of the cam relative to the follower.
Figure 12:
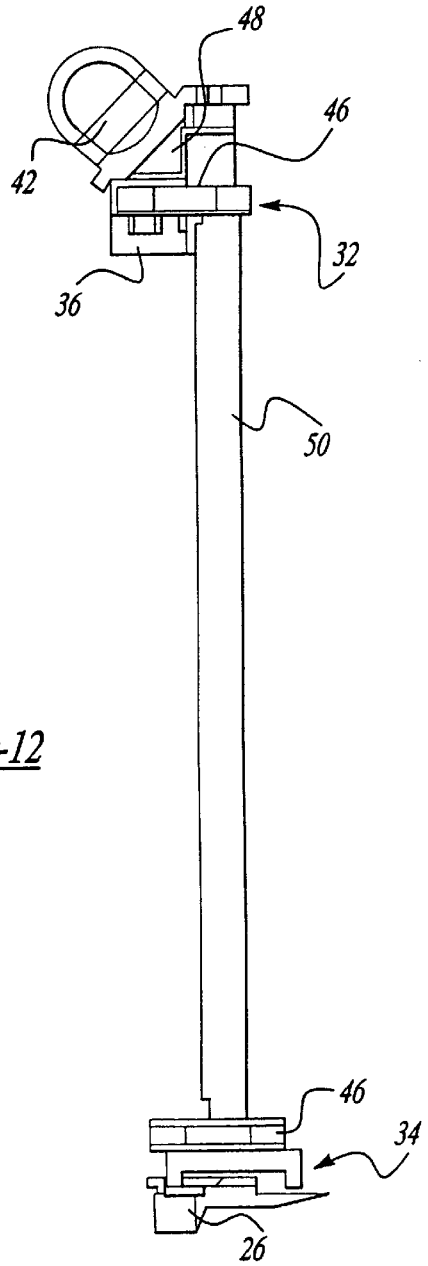
FIG. 12 is a sectional view, partly diagrammatic, as seen from substantially the line 12—12 in FIG. 1 for the purpose of showing the actuator for the slide members and the upper and lower slide members which are connected so that they move in unison.

An actuator member 42 (FIGS. 2 and 12) on the upper end of the door 16 is slidably mounted on a plate member 44 on top of the slide member 36 so that the actuator 42 can move the slide 36 between the extreme positions shown in FIG. 2 and FIG. 4. An actuator link 46 is secured by a pin 48 at one end to the actuator member 42. At its other end, the link 46 is secured to the upper end of a shaft 50 which is connected at its lower end to another actuator link 46 connected to the slide member 36 in the lower hinge control assembly 34. This connection of the upper and lower slide members 36 with the shaft 50 assures unified movement of the upper and lower slide members 36.

In the event it is desired to have the door 16 pivot about the right hand axis 30, the actuating member 42 is moved to the right to the extreme position shown in FIG. 4 in which the slot 38 is moved to a clearance position with the left hinge pin 20 and the slot 40 is moved to a position in which the hinge pins 22 are captured in the slots 40 so that the door 16 can pivot about the axis 30.

Figure 3:
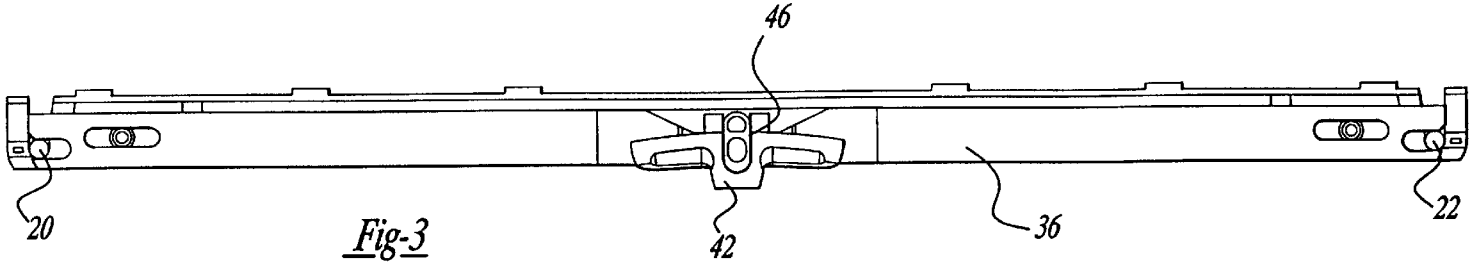
FIG. 3 is a plan view similar to FIG. 2 showing the upper slide member in a center position in which the upper and lower slide members are locked on the hinge pins so that the closure door for the cabinet is maintained in a closed position, usually desirable when the RV is moving.

FIG. 3 illustrates the result of positioning the actuator 42 in a neutral position in which both the hinge pins 20 and the hinge pins 22 are positioned in the slots 38 and 40 blocking movement of the slide members 36 in a direction away from the front side 26 of the cabinet 12. Thus, in the FIG. 3 position of the actuator, the door 16 is locked in a closed position during travel of the recreational vehicle so that the door 16 does not inadvertently fly open.

In the open position of the refrigerator door 16 the entire weight of the door 16 is on the support bracket legs 24 at the supported end of the door 16. This causes the door 16 to sag at its free end.

Figure 5:
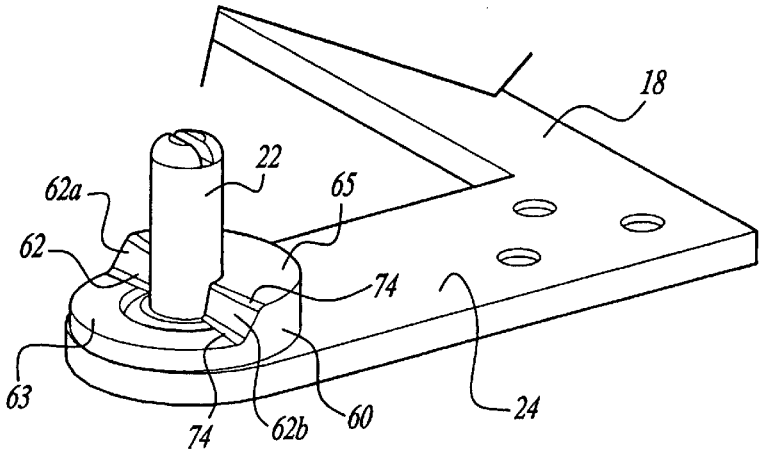
FIG. 5 is an enlarged perspective view of a hinge pin at the lower end of the door and provided with a cam for lifting the door in response to opening movement of the door.
Figure 10:
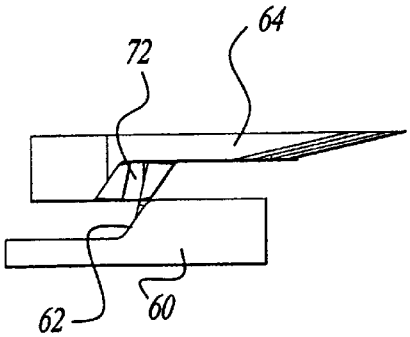
FIG. 10 is an elevational view of the cam and follower in the relative positions shown in FIG. 9.

To prevent door sag from interfering with door closing, cams 60 are provided on the hinge pins 20 and 22 (FIG. 5) at the lower end of the cabinet 12 and cam followers are provided on the bottom corners of the door 16. The cams 60 on the hinge pins 20 and 22 are identical so only the one for the lower hinge pin 22 is illustrated in FIG. 5. The cam 60 is secured to the leg 24 of the bracket and has an upwardly inclined step surface 62, having portions 62*a* and 62*b* which extend between lower and upper surfaces 63 and 65. The cam portions 62*a* and b are of a twisted shape so as to enhance contact with a cam follower 64. It should be pointed out that only one of the cam surface portions 62*a* and b is used in each cam 60. Each cam 60 is constructed as shown in FIGS. 5 and 10 for efficiency of manufacture. It is easier to make one cam 60 for both pins 20 and 22 than it is to make special cams for each. The hinge control assembly 34 at the lower end of the door 16 is provided with the cam followers 64 at positions in which a follower 64 will interact with a cam 60 at the axis 28 or 30 which is being used as the pivot axis.

Figure 7:
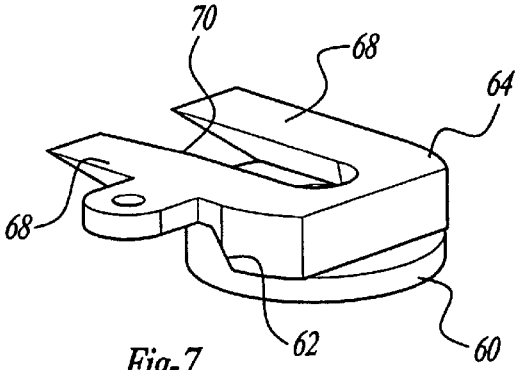
FIG. 7 is a perspective view of the cam and follower shown in FIG. 6, illustrating the relative positions of the cam and follower when the refrigerator door is closed.
Figure 8:
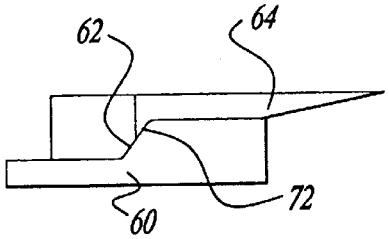
FIG. 8 is an elevational view of the cam and follower in the position shown in FIG. 7.
Figure 11:
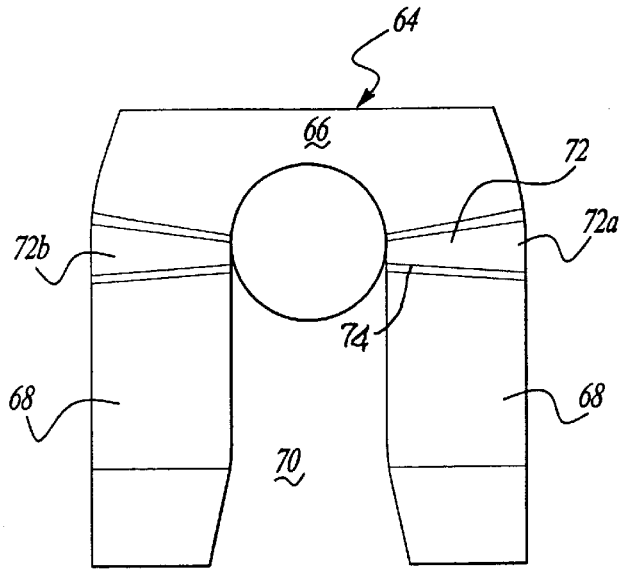
FIG. 11 is a bottom view of the cam follower.

Accordingly, the lower side of the hinge control assembly 34 on the door 16 has a follower 64 secured to it and extending downwardly into engagement with a corresponding cam 60, as shown in FIG. 7. Each follower is of U-shape having a base 66 and legs 68 on opposite sides of a slot 70. The hinge pin 20 or 22 is positioned in the slot 70 between the legs 68. FIGS. 7 and 8 illustrate the relative positions of the cam and cam follower when the door 16 is closed. As shown in FIG. 11, the inclined surface 72 on the cam follower 64 has portions 72*a* and 72*b* (FIG. 11) which are twisted like the cam surfaces 62*a* and 62*b*, so as to follow the corresponding inclined surface portions on the cam 60. The areas 74 (FIGS. 5 and 11) on the cam 60 and follower 64 are rounded surfaces which smooth out the movement of the follower on the cam.

Figure 9:
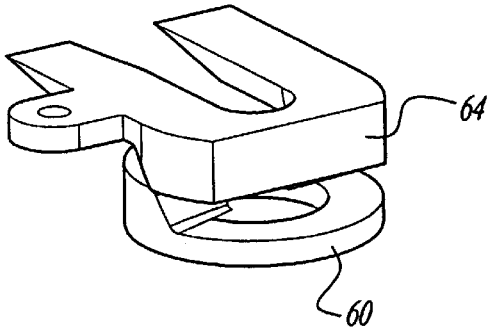
FIG. 9 is a perspective view like FIG. 7 showing the follower rotated to its uppermost position on the cam.

As the door 16 is opened, the first few degrees of movement will force the follower 64 to move up the cam surface 62*b* from the position shown in FIGS. 7 and 8 to the position shown in FIGS. 9 and 10. In this position, the cam follower 64 rests on the higher surface 65. As the door is closed, the follower moves progressively down the incline 62 in the last few degrees of movement to return to the positions of the cam and follower shown in FIG. 7.

In the event the door 16 is to be removed from the cabinet 12, it is only necessary to move the door 16 to the partially open position shown in FIG. 1 with the actuator slide 36 in the position shown in FIG. 4. With the door in the partially open position shown in FIG. 1, it is only necessary to move the actuator 42 from the position shown in FIG. 4 to the position shown in FIG. 2 in which the hinge pins 22 are uncoupled from the slide member 36 so that the door can simply be lifted off the hinge pins 22.

This is an advantageous feature of the invention which plays an important role in the efficient assembly of an RV with an RV refrigerator such as the one shown at 10 in the drawing. At the time that the RV is being assembled, it is advantageous to be able to install the RV refrigerator without concern as to whether or not other arrangements on the other side of the vehicle would dictate use of the refrigerator with the door in a particular position. The present invention enables the RV manufacturer to install the cabinet 12 without the door 16 and wait until the RV is to be sold before the door 16 is mounted on the cabinet 12.

It can thus be seen that this invention provides an RV refrigerator which can be expeditiously installed in a new or used RV without causing the interior of the RV to be unduly affected by the installation of the refrigerator.

We claim:

1. A refrigerator comprising an upright cabinet with an internal cold compartment and an access opening to said compartment on one side of said cabinet, and a door member mounted on said one side of said cabinet for closing said compartment, two pairs of upright hinge pins on said cabinet on opposite sides of said opening, said door member having top and bottom ends, a pair of hinge control assemblies on said top and bottom door ends, each of said assemblies having an actuating slide member manually movable right to left and vice versa in a substantially horizontal direction relative to said door member between left and right positions, a pair of slots in each of said slide members extending in said substantially horizontal direction at the ends of the slide members and open at the ends of said slide members so that said hinge pins can be captured in said slots when the open ends of the slots are moved toward said pins, said top and bottom slide members being operable in said left slide position to capture the hinge pins on the left side so as to pivotally mount the left ends of said slide members on said left side hinge pins, thereby enabling pivoting of said door about a vertical axis on the left side of said door to a partially or fully open position, said top and bottom slide members being operable in said right slide position to capture the hinge pins on the right side so as to pivotally mount the right ends of said slide members on said right side hinge pins and position the left ends of the slide members in a clearance relation with the left side hinge pins, thereby enabling pivoting of said door about a vertical axis on the right side of said door to a partially or fully open position.

2. The refrigerator according to claim 1 comprising further means on each of said top and bottom slide members enabling movement of said slides to a center position between said left and right positions, said pair of slot members in each of said slide members being configured so that in said center positions of said slide members both sets of hinge pins are captured in said slots at the ends of said slide members to thereby lock said door on said cabinet.

* * * * *